US006615529B1

(12) United States Patent
Seecamp

(10) Patent No.: US 6,615,529 B1
(45) Date of Patent: Sep. 9, 2003

(54) TRIGGER SAFETY

(76) Inventor: Lueder Seecamp, 345 Edgefield Ave., Milford, CT (US)

( * ) Notice: Subject to any disclaimer, the term of this patent is extended or adjusted under 35 U.S.C. 154(b) by 0 days.

(21) Appl. No.: 10/264,239

(22) Filed: Oct. 3, 2002

(51) Int. Cl.[7] ..... F41A 17/00
(52) U.S. Cl. ..... 42/70.06; 89/148; 89/27.12
(58) Field of Search ..... 42/70.06, 70.01, 42/66; 89/148, 27.12

(56) References Cited

U.S. PATENT DOCUMENTS

| | | | | |
|---|---|---|---|---|
| 707,925 A | | 8/1902 | Herndon | |
| 2,401,482 A | | 6/1946 | Hendey | |
| 2,490,922 A | | 12/1949 | Rutherford et al. | |
| 2,635,380 A | | 4/1953 | Baker et al. | |
| 2,657,490 A | | 11/1953 | Browning | |
| 2,711,043 A | | 6/1955 | Bent | |
| 2,856,718 A | | 10/1958 | Fisher | |
| 3,324,587 A | | 6/1967 | Bryan | |
| 3,711,979 A | | 1/1973 | Small | |
| 3,713,239 A | | 1/1973 | Sperling | |
| 3,715,826 A | | 2/1973 | Seified | |
| 3,732,641 A | | 5/1973 | Adajian | |
| 3,978,604 A | | 9/1976 | Smith | 42/70.07 |
| 4,067,132 A | | 1/1978 | Smith | 42/66 |
| 4,677,781 A | | 7/1987 | Lee | 42/70.01 |
| 4,719,713 A | * | 1/1988 | Hagle | 42/1.01 |
| 4,754,568 A | | 7/1988 | Brandt | 42/70.06 |
| 5,025,582 A | | 6/1991 | Mote | 42/70.06 |
| 5,033,218 A | | 7/1991 | Nelson | 42/70.07 |
| 5,355,768 A | | 10/1994 | Felk | 89/147 |
| 5,402,593 A | | 4/1995 | Lenkarski et al. | 42/70.06 |
| 5,724,760 A | | 3/1998 | Langner | 42/70.07 |
| 5,778,587 A | | 7/1998 | Brandl et al. | 42/70.08 |
| 5,799,434 A | | 9/1998 | Krieger et al. | 42/69.03 |
| 6,212,812 B1 | * | 4/2001 | Aigner | 42/70.06 |
| 6,223,460 B1 | * | 5/2001 | Schmitter et al. | 42/70.06 |
| 6,301,816 B1 | * | 10/2001 | Saltz | 42/70.06 |

FOREIGN PATENT DOCUMENTS

| | | |
|---|---|---|
| DE | 4303333 | 2/1993 |

* cited by examiner

*Primary Examiner*—J. Woodrow Eldred
(74) *Attorney, Agent, or Firm*—St. Onge Steward Johnston & Reens LLC

(57) ABSTRACT

A firearm includes a frame having a trigger guard defined by an upper wall, a lower wall, a rear wall and a forward wall, and a trigger pivotally mounted to the frame, the trigger having a hole passing therethrough. A trigger bar is disposed in the hole and is transversely slideable therein between a fire position wherein the trigger is pivotable with respect to the frame and the firearm may be discharged, and a safe position wherein the trigger bar and the upper wall of the trigger guard interfere with one another such that the trigger is not pivotable with respect to the frame and the firearm may not be discharged. Transverse movement of the trigger bar out of the hole is prevented by contact of the trigger bar with the frame as the trigger bar is pushed in either transverse direction.

23 Claims, 4 Drawing Sheets

TRIGGER SAFETY

FIELD OF THE INVENTION

The present invention relates to safety mechanisms for firearms and more particularly to a trigger safety mechanism for preventing accidental discharge of a firearm by inadvertent trigger manipulation.

BACKGROUND OF THE INVENTION

The State of California requires any new semi-automatic pistol sold within the State to have a "positive manually operated safety device as defined by the Bureau of Alcohol, Tobacco and Firearms (BATF) import criteria," and it is expected that this requirement will be imposed by other states in the future. The present invention comprises a trigger block safety that is in direct response to such legislation. The present invention, in the preferred embodiment shown in the drawings, has passed the California requirement by meeting the current BATF criteria on manually operated safety devices. Pistols incorporating the present invention have recently been approved for sale within the State of California.

The present invention was specifically designed to provide the most unobtrusive manually operated safety possible to a firearm having a pivoting trigger that is used to both cock and release the hammer or striker to fire the weapon. Such trigger-cocking firearms are commonly referred to as being "double-action." In contrast, a "single-action" firearm is one in which the hammer or striker is held in a cocked position through some mechanical means, usually called a sear, and the trigger is used to trip the sear so that the gun fires when the trigger is pulled. Trigger-cocking firearms are referred to as "double-action only" if there is no single-action capability. In a "double action only" firearm, the trigger is used to cock and release the firing mechanism for each and every shot. For purposes of this application, the term "trigger-cocking" rather than the term "double-action" will be used herein to describe the process of a trigger both cocking and releasing the firing mechanism with a single trigger pull. The term "trigger-cocking only" will be used herein to describe those firearms having no single-action capability.

The trigger pull of a trigger-cocking firearm is by necessity much longer and heavier than the trigger pull of a single-action firearm. A deliberate and conscious effort must be made for discharge to take place. Trigger-cocking only firearms have therefore customarily not been provided with manually operated safeties to block the trigger function. The length and the weight of the pull has been considered sufficient protection against accidental discharge through inadvertent trigger manipulation.

Trigger-cocking only firearms are typically defensive firearms, intended for self-protection rather than target shooting or hunting. In self defense, a prospective shooter must always be aware of the condition of his or her gun. A safety that can be accidentally switched on (e.g., into a safe position) can be as much of a hazard to the defensive shooter as a safety that accidentally switches to the off position (e.g., into the fire position) is to a hunter or sportsman. Many self-protection weapons are deliberately made with small or no sights or other protrusions which would snag on clothing in a quick draw situation. A problem with installing manually operated safeties in such weapons is that the weapons can lose their streamlined snag-free configuration. Further, by providing them with unnecessary exposed appendages intended to be safety devices these weapons may in fact be made less safe rather than more safe if the safety gets snagged in clothing and changes position between a firing position and a safe position. The smaller the pistol, the closer it is carried to the person without the benefit of the elaborate holstering that secures the condition of the gun, and the greater the likelihood the safety will accidentally shift positions.

A trigger bar safety is a design in which a safety blocks movement of the trigger. Trigger bar safeties are in themselves not new and numerous designs have been created incorporating trigger bar safeties into firearms.

The problem of incorporating a trigger bar safety into a firearm involves doing so elegantly within the limitations of the available space. One primary problem is how to retain a bar or button so that it may not be pressed laterally out of the firearm. Another problem involves how to position the trigger bar safety such that it blocks the firing mechanism without being susceptible to inadvertent switching between the "safe" position and the "fire" position.

U.S. Pat. No. 6,223,460 discloses a trigger safety for a pistol that includes a laterally slideable plug incorporated into the trigger, which when slid laterally to extend beyond the confines of the trigger, will prevent rearward movement of the trigger by the plug's interference with the pistol frame. A spring internal to the trigger engages notches in the plug as it is moved from one position to another, thereby retaining the plug when it is positioned in either the safe position or the fire position. This design suffers from a number of disadvantages. One problem is that although the spring engages notches in the plug in order to bias the plug in either the "safe" position or the "fire" position, the spring is unable to prevent the plug from being forced all the way out of the trigger. Thus, the plug may be popped out of the trigger, rendering the trigger safety inoperable. Another problem is the position of the plug on the trigger. The plug is located relatively low on the trigger close to the rear of the trigger guard, thereby causing the rear of the trigger guard to interfere with the plug when in the "safe" position. However, with the plug located this low on the trigger, the plug is susceptible to inadvertent switching between the "safe" position and the "fire" position. Moreover, this design does not provide a streamlined snag-free configuration.

What is desired, therefore, is a manually operable trigger safety for preventing accidental discharge of a firearm by inadvertent trigger manipulation, which is mountable on the trigger of the firearm, which provides a streamlined snag-free configuration, which may not be removed from the firearm if it is pushed too far in one direction, and which is not susceptible to being inadvertently switched between the "safe" position and the "fire" position.

SUMMARY OF THE INVENTION

Accordingly, it is an object of the present invention to provide a manually operable trigger safety for preventing accidental discharge of a firearm by inadvertent trigger manipulation which is mountable on the trigger of the firearm.

Another object of the present invention is to provide a manually operable trigger safety having the above characteristics and which provides a streamlined snag-free configuration.

A further object of the present invention is to provide a manually operable trigger safety having the above characteristics and which may not be removed from the firearm if it is pushed too far in one direction.

Still another object of the present invention is to provide a manually operable trigger safety having the above characteristics and which is not susceptible to being inadvertently switched between the "safe" position and the "fire" position.

These and other objects of the present invention are achieved by provision of a firearm incorporating a manually operable trigger safety for preventing accidental discharge of a firearm by inadvertent trigger manipulation. The firearm includes a frame having a trigger guard defined by an upper wall, a lower wall, a rear wall and a forward wall, and a trigger pivotally mounted to the frame, the trigger having a hole passing therethrough. A trigger bar is disposed in the hole and is transversely slideable in the hole between a fire position wherein the trigger is pivotable with respect to the frame and the firearm may be discharged and a safe position wherein the trigger bar and the upper wall of the trigger guard interfere with one another such that the trigger is not pivotable with respect to the frame and the firearm may not be discharged. Transverse movement of the trigger bar out of the hole in the trigger is prevented by contact of the trigger bar with the frame as the trigger bar is pushed in either transverse direction.

Preferably, the frame comprises a main frame member and a plate attached to a side of the main frame member, the plate blocking at least a portion of the trigger bar such that transverse movement of the trigger bar out of the hole in the trigger is prevented as the trigger bar is pushed toward and contacts the plate. Most preferably, the trigger bar is in the fire position when the trigger bar is proximate to the plate. In one embodiment, the trigger bar preferably comprises a first portion having a first cross-sectional dimension, a second portion having a second cross-sectional dimension smaller than the first cross-sectional dimension and a side wall connecting the first portion and the second portion. Transverse movement of the trigger bar out of the hole in the trigger is prevented as the trigger bar is pushed in a direction from the first portion toward the second portion by contact of the side wall with the frame. It is most preferable that the second portion of the trigger bar overlies and interferes with the upper wall of the trigger guard of the frame upon attempts to pivot the trigger with respect to the frame when the side wall of the trigger bar is proximate to the frame whereby the trigger bar is in the safe position.

The trigger preferably further comprises a spring in contact with and biased toward the trigger bar such that transverse movement of the trigger bar in the hole in the trigger is resisted by frictional engagement of the spring and the trigger bar. Most preferably, the trigger bar includes a notch therein in a location where the spring contacts the trigger bar when the trigger bar is in the fire position to further resist transverse movement of the trigger bar out of the fire position.

The invention and its particular features and advantages will become more apparent from the following detailed description considered with reference to the accompanying drawings.

DETAILED DESCRIPTION OF AN EMBODIMENT OF THE INVENTION

Figure 1:
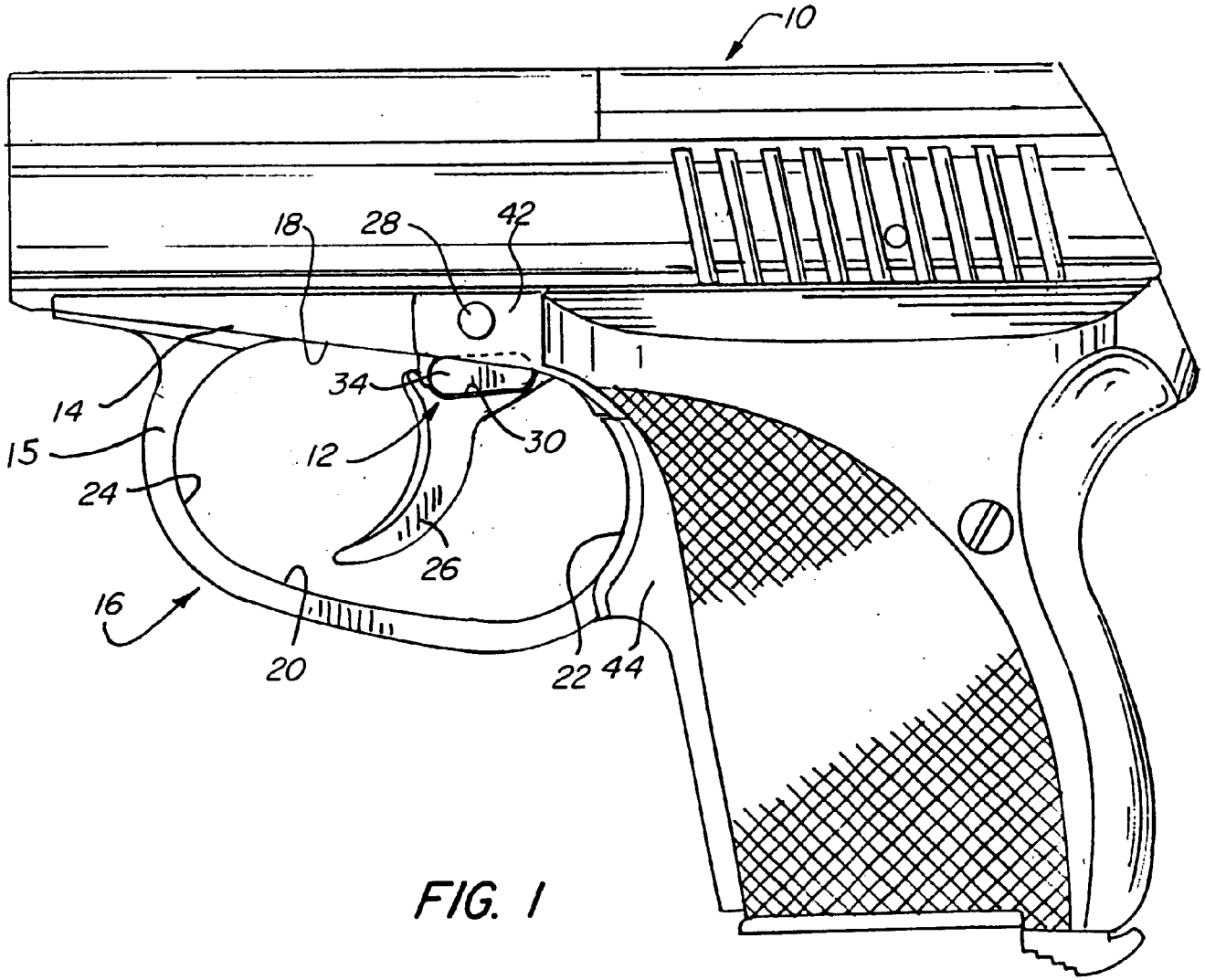
FIG. 1 is a left side plan view of a firearm incorporating a manually operable trigger safety for preventing accidental discharge of the firearm in accordance with an embodiment of the present invention.
Figure 2:
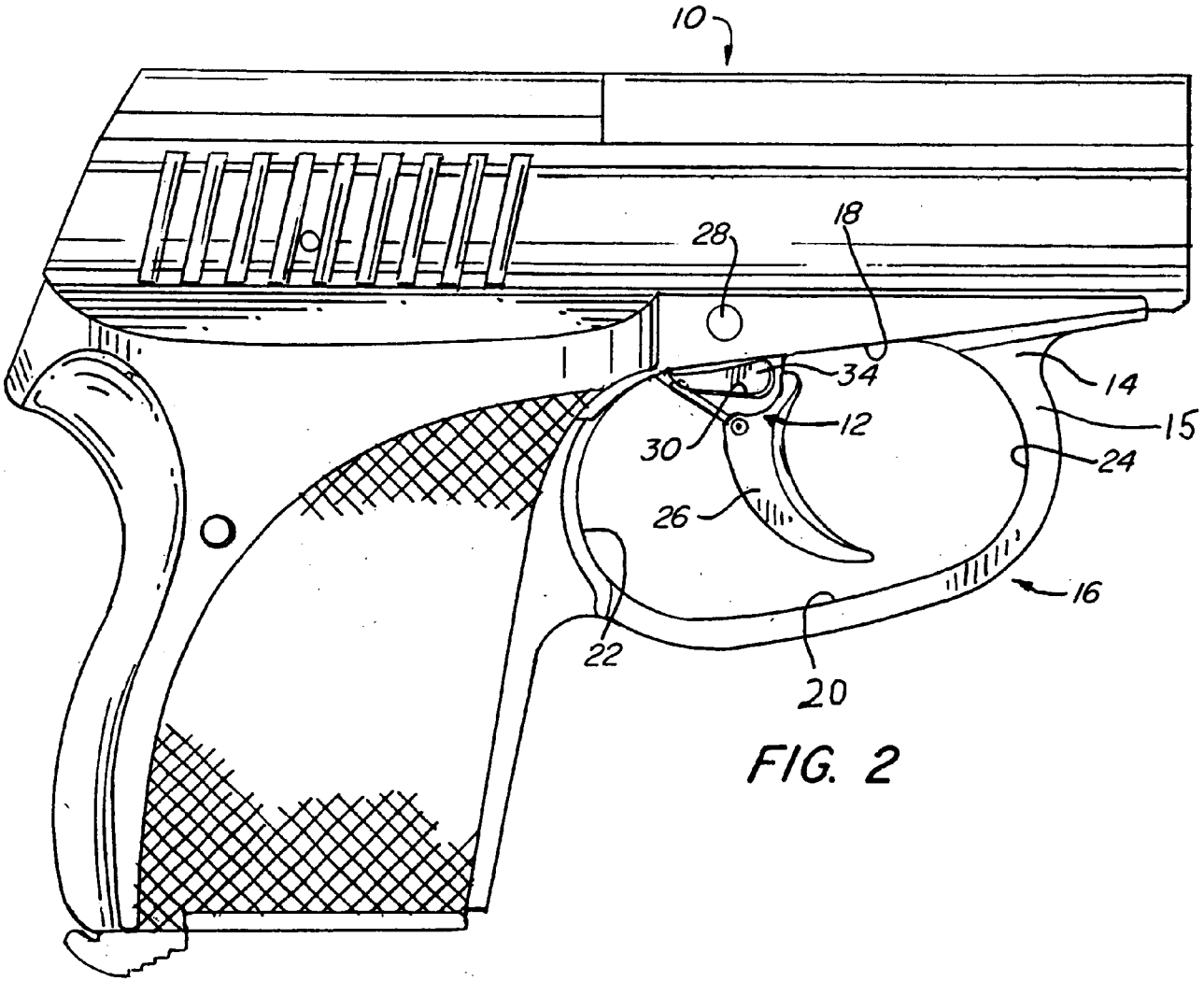
FIG. 2 is a right side plan view of the firearm incorporating a manually operable trigger safety for preventing accidental discharge of the firearm of FIG. 1.

Referring first to FIGS. 1 and 2 a firearm 10 incorporating a manually operable trigger safety 12 for preventing accidental discharge of firearm 10 by inadvertent trigger manipulation is shown. Firearm 10 includes a frame 14 having a trigger guard 16 defined by an upper wall 18, a lower wall 20, a rear wall 22 and a forward wall 24.

It should be understood that when directional references are made herein, such as "upper," "lower", "rear," "forward," "left," "right," etc. such references refer to the typical orientation of a firearm as it is being held and fired, as shown in the Figures. It should also be understood that although a particular orientation of parts is shown in the Figures and discussed herein (e.g., with the safety being in the fire position when pushed from right to left and being in the safe condition when pushed from left to right), such orientation is not meant to be limiting in any way, and that one skilled in the art could easily reverse the various elements without departing from the spirit or scope of the present invention.

Figure 7:
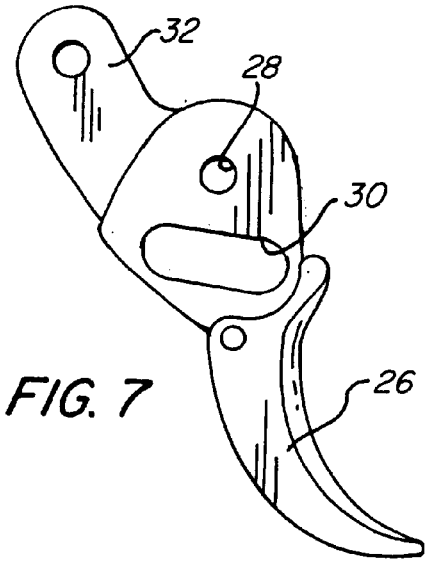
FIG. 7 is an enlarged right side plan view of the trigger portion of the firearm incorporating a manually operable trigger safety for preventing accidental discharge of the firearm of FIG. 1.

Firearm 10 also includes a trigger 26 pivotally mounted to frame 14 by a pivot pin 28 or the like as is commonly known in the art. Trigger 26 includes a hole 30 passing therethrough, and may also include various other components 32 for connecting trigger 26 to the firing mechanism of firearm 10 (best seen in FIG. 7). As many and various such components 32 and systems for connecting trigger 26 to firing mechanisms are known in the art, and as the particular manner in which trigger 26 is connected to the firing mechanism is not germane to the present invention, such is not discussed in detail herein or shown in detail in the Figures.

Figure 3:
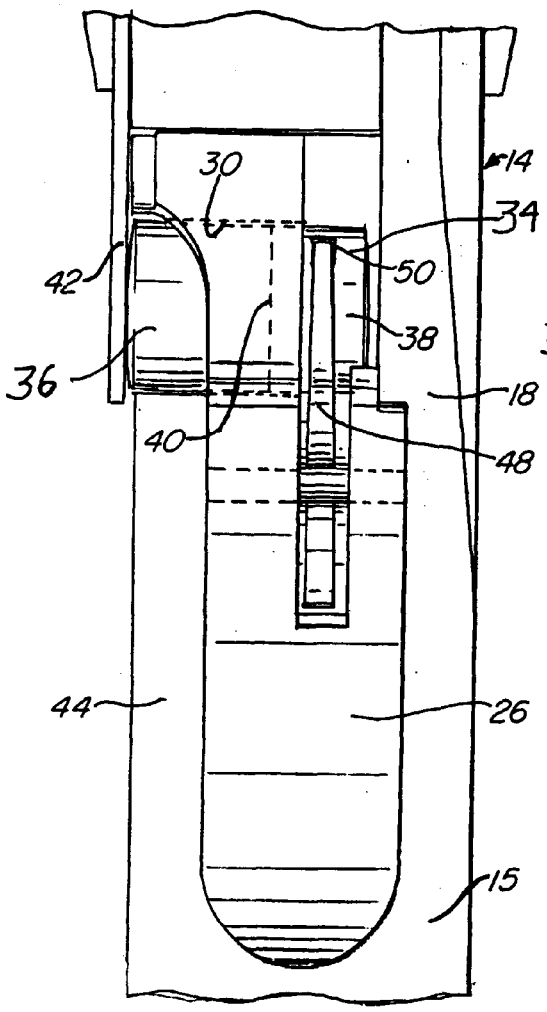
FIG. 3 is a bottom plan view of a portion of the firearm incorporating a manually operable trigger safety for preventing accidental discharge of the firearm of FIG. 1 with the trigger safety shown in the "fire" position.
Figure 4:
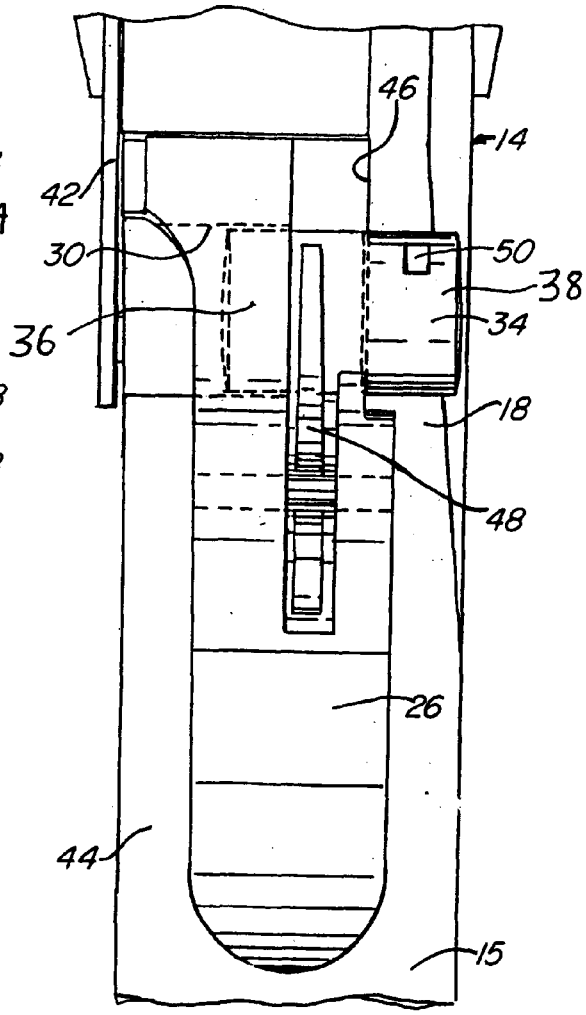
FIG. 4 is a bottom plan view of a portion of the firearm incorporating a manually operable trigger safety for preventing accidental discharge of the firearm of FIG. 1 with the trigger safety shown in the "safe" position.
Figure 6:
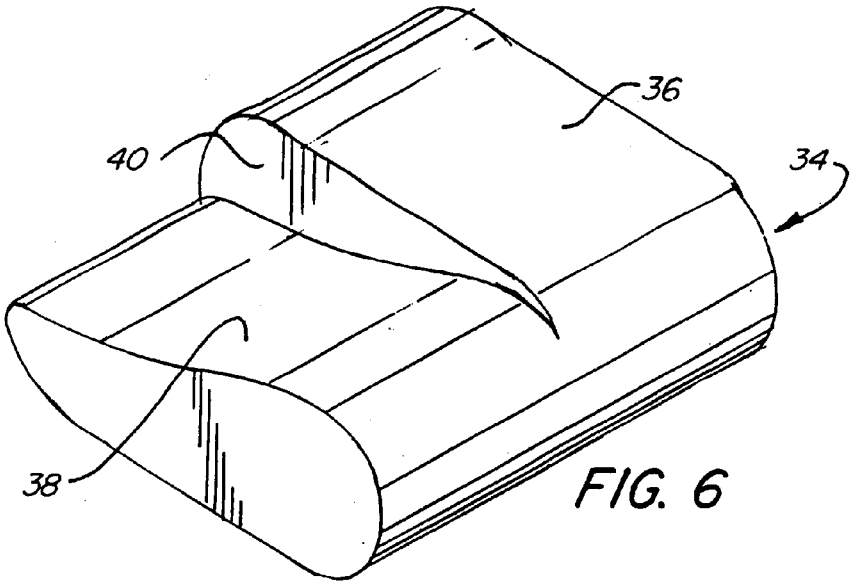
FIG. 6 is an enlarged left side isometric view of the trigger bar portion of the manually operable trigger safety for preventing accidental discharge of a firearm of FIG. 1.
Figure 5:
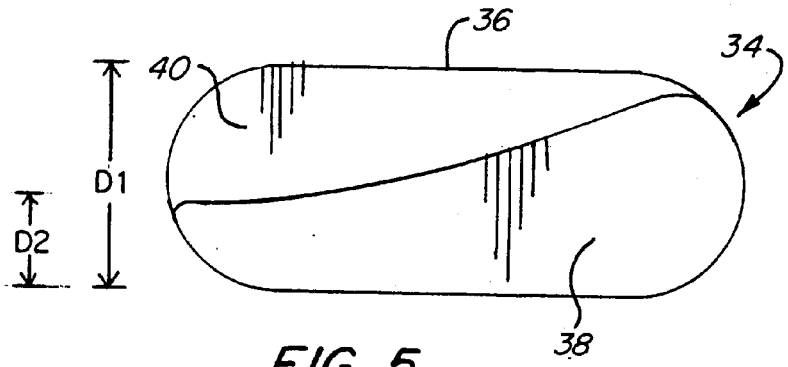
FIG. 5 is an enlarged left side plan view of the trigger bar portion of the manually operable trigger safety for preventing accidental discharge of a firearm of FIG. 1.

A trigger bar 34 is disposed in hole 30 and is transversely slideable in hole 30 between a fire position (shown in FIG. 3) and a safe position (shown in FIG. 4). As best seen in FIGS. 5 and 6, trigger bar 34 comprises a first portion 36 having a first cross-sectional dimension D1, a second portion 38 having a second cross-sectional dimension D2 smaller than first cross-sectional dimension D1. A side wall 40, generally orthogonal to the path of transverse movement of trigger bar 34 within hole 30, connects first portion 36 and second portion 38.

In the fire position, trigger 26 is pivotable with respect to frame 14 as there is no interference between trigger bar 34 and frame 14. Thus, firearm 10 may be discharged by pulling trigger 26 rearward. In the safe position, at least part of second portion 38 of trigger bar 34 overlies upper wall 18 of trigger guard 16 when viewed from below such that trigger bar 34 and frame 14 interfere with one another such that trigger 26 is not pivotable with respect to frame 14 and firearm 10 may not be discharged by manipulation of trigger 26. Trigger bar 34 may be moved to the safe position by pushing second portion 38 thereof toward first portion 36 and may be moved to the fire position by pushing first portion 36 thereof toward second portion 38.

Transverse movement of trigger bar 34 out of hole 30 in trigger 26 is prevented by contact of trigger bar 34 with frame 14 as trigger bar 34 is pushed in either transverse direction. More specifically, transverse movement of trigger bar 34 out of hole 30 in trigger may be prevented in one direction by a plate 42 attached to a side of a main frame member 44, which plate 42 and main frame member 44 together comprise frame 14. Plate 42 is positioned so as to block or overlie at least a portion of first section 36 of trigger bar 34 when viewed from the side (as shown in FIG. 1), such that transverse movement of trigger bar 34 out of hole 20 in trigger 26 is prevented as trigger bar 34 is pushed toward and contacts plate 42 (best seen in FIG. 3). Of course, a least a portion of first section 36 should not be overlaid by plate 42 so that trigger bar 34 is easily accessible by a shooter so that it may be moved between the safe and fire positions. As seen in FIG. 3, trigger bar 34 is in the fire position when trigger bar 34 is proximate to plate 42. Transverse movement of trigger bar 34 out of hole 30 in trigger 26 is prevented as trigger bar 34 is pushed in a direction from first portion 36 toward second portion 38 by contact of side wall 40 with a surface 46 of frame 14 when second portion 38 of trigger bar 34 overlies upper wall 18 of trigger guard 16 of frame 14 when viewed from below (best seen when FIG. 4 is taken in combination with FIG. 2).

In FIGS. 3 and 4, the lower part of the Figures is the front part 15 of the trigger guard 16 of firearm 10, and the upper part is the rear part of the trigger area of firearm 10. As best seen in FIGS. 3 and 4, trigger 26 may include a spring 48 in contact with and biased toward trigger bar 34 such that transverse movement of trigger bar 34 in hole 30 is resisted by frictional engagement of spring 48 and trigger bar 34. This frictional engagement inhibits unintentional movement of trigger bar 34 within hole 30 between the fire and safe positions such as might occur by jostling of firearm 10 or the like. Trigger bar 34 may further include a notch 50 therein in a location where spring 48 contacts trigger bar 34 when trigger bar 34 is in the fire position to further resist transverse movement of trigger bar 34 out of the fire position. Thus, inadvertent movement of trigger bar 34 out of the fire position is made further unlikely. As discussed more fully above in the Background section, this is particularly important in connection with trigger cocking only firearms, particularly such firearms used for personal defense. A second notch (not shown) may be provided in a location where spring 48 contacts trigger bar 34 when trigger bar 34 is in the safe position to further resist transverse movement of trigger bar 34 out of the safe position, although maintaining trigger bar 34 in the safe position is not as important to defensive shooters, as trigger safety 12 as a whole may be considered superfluous, particularly in the case of trigger cocking only firearms.

The present invention, therefore, provides a manually operable trigger safety for preventing accidental discharge of a firearm by inadvertent trigger manipulation, which is mountable on the trigger of the firearm, which provides a streamlined snag-free configuration, which may not be removed from the firearm if it is pushed too far in one direction, and which is not susceptible to being inadvertently switched between the "safe" position and the "fire" position.

Moreover, the present invention solves the California requirement both elegantly and sensibly. The trigger bar safety herein described is sufficiently exposed to be considered a manually operated safety under BATF guidelines, yet the safety bar is also fairly well protected from accidental manipulation. The safety is cosmetically inoffensive and allows the weapon to maintain its snag-free contours. The actual operation of the safety is simple and its usage or non-usage can be left to the discretion of the owner. Properly used, the safety can hinder firing of the weapon should it fall into the wrong hands. Being a non-traditional safety, it would certainly frustrate, at least temporarily, any individual not familiar with its operation.

Although the invention has been described with reference to a particular arrangement of parts, features and the like, these are not intended to exhaust all possible arrangements or features, and indeed many other modifications and variations will be ascertainable to those of skill in the art.

For example, although the manually operable trigger safety of the present invention provides exceptional benefits for trigger-cocking only type handguns, it should be understood that it may be incorporated into any type of firearm, including any trigger cocking handgun, manually cocking handguns, rifles, shotguns, etc. Many other adaptations and modifications may also be made without departing from the spirit and scope of the present invention.

What is claimed is:

1. A firearm incorporating a manually operable trigger safety for preventing accidental discharge of the firearm, said firearm comprising:

a frame;

a trigger pivotally mounted to said frame, said trigger having a hole passing therethrough;

a trigger bar disposed in the hole in said trigger, said trigger bar being transversely slideable in the hole between a fire position wherein said trigger is pivotable with respect to said frame and the firearm may be discharged and a safe position wherein said frame and said trigger bar interfere with one another such that said trigger is not pivotable with respect to said frame and the firearm may not be discharged; and wherein transverse movement of said trigger bar out of the hole in said trigger is prevented by contact of the trigger bar with said frame as the trigger bar is pushed in either transverse direction.

2. The firearm of claim 1 wherein said frame further comprises a trigger guard having an upper wall, a lower wall, a rear wall and a forward wall and wherein said trigger bar is positioned in said trigger proximate to the upper wall of said trigger guard such that when in the safe position said trigger bar and the upper wall of said trigger guard interfere with one another such that said trigger is not pivotable with respect to said frame and the firearm may not be discharged.

3. The firearm of claim 1 wherein said frame comprises a main frame member and a plate attached to a side of said main frame member, said plate blocking at least a portion of said trigger bar such that transverse movement of said trigger bar out of the hole in said trigger is prevented as the trigger bar is pushed toward and contacts said plate.

4. The firearm of claim 3 wherein said trigger bar is in the fire position when said trigger bar is proximate to said plate.

5. The firearm of claim 1 wherein said trigger bar comprises a first portion having a first cross-sectional dimension, a second portion having a second cross-sectional dimension smaller than the first cross-sectional dimension and a side wall connecting said first portion and said second portion, and wherein transverse movement of said trigger bar out of the hole in said trigger is prevented as the trigger bar is pushed in a direction from said first portion toward said second portion by contact of said side wall with said frame.

6. The firearm of claim 5 wherein the second portion of said trigger bar overlies and interferes with said frame upon attempts to pivot said trigger with respect to said frame when said side wall of said trigger bar is proximate to said frame whereby said trigger bar is in the safe position.

7. The firearm of claim 1 wherein said trigger further comprises a spring in contact with and biased toward said trigger bar such that transverse movement of said trigger bar in the hole in said trigger is resisted by frictional engagement of said spring and said trigger bar.

8. The firearm of claim 7 wherein said trigger bar includes a notch therein in a location where said spring contacts said trigger bar when said trigger bar is in the fire position to further resist transverse movement of said trigger bar out of the fire position.

9. A firearm incorporating a manually operable trigger safety for preventing accidental discharge of the firearm, said firearm comprising:

a frame having a trigger guard defined by an upper wall, a lower wall, a rear wall and a forward wall;

a trigger pivotally mounted to said frame, said trigger having a hole passing therethrough; and a trigger bar disposed in the hole in said trigger, said trigger bar being transversely slideable in the hole between a fire position wherein said trigger is pivotable with respect to said frame and the firearm may be discharged and a safe position wherein said trigger bar and the upper wall of the trigger guard interfere with one another such that said trigger is not pivotable with respect to said frame and the firearm may not be discharged.

10. The firearm of claim 9 wherein transverse movement of said trigger bar out of the hole in said trigger is prevented by contact of the trigger bar with said frame as the trigger bar is pushed in either transverse direction.

11. The firearm of claim 9 wherein said frame comprises a main frame member and a plate attached to a side of said main frame member, said plate overlying at least a portion of said trigger bar such that transverse movement of said trigger bar out of the hole in said trigger is prevented as the trigger bar is pushed toward and contacts said plate.

12. The firearm of claim 11 wherein said trigger bar is in the fire position when said trigger bar is proximate to said plate.

13. The firearm of claim 9 wherein said trigger bar comprises a first portion having a first cross-sectional dimension, a second portion having a second cross-sectional dimension smaller than the first cross-sectional dimension and a side wall connecting said first portion and said second portion, and wherein transverse movement of said trigger bar out of the hole in said trigger is prevented as the trigger bar is pushed in a direction from said first portion toward said second portion by contact of said side wall with said frame.

14. The firearm of claim 13 wherein the second portion of said trigger bar overlies and interferes with the upper wall of the trigger guard of said frame upon attempts to pivot said trigger with respect to said frame when said side wall of said trigger bar is proximate to said frame whereby said trigger bar is in the safe position.

15. The firearm of claim 9 wherein said trigger further comprises a spring in contact with and biased toward said trigger bar such that transverse movement of said trigger bar in the hole in said trigger is resisted by frictional engagement of said spring and said trigger bar.

16. The firearm of claim 15 wherein said trigger bar includes a notch therein in a location where said spring contacts said trigger bar when said trigger bar is in the fire position to further resist transverse movement of said trigger bar out of the fire position.

17. A firearm incorporating a manually operable trigger safety for preventing accidental discharge of the firearm, said firearm comprising:

a frame having a trigger guard defined by an upper wall, a lower wall, a rear wall and a forward wall;

a trigger pivotally mounted to said frame, said trigger having a hole passing therethrough;

a trigger bar disposed in the hole in said trigger, said trigger bar being transversely slideable in the hole between a fire position wherein said trigger is pivotable with respect to said frame and the firearm may be discharged and a safe position wherein said trigger bar and the upper wall of the trigger guard interfere with one another such that said trigger is not pivotable with respect to said frame and the firearm may not be discharged; and wherein transverse movement of said trigger bar out of the hole in said trigger is prevented by contact of the trigger bar with said frame as the trigger bar is pushed in either transverse direction.

18. The firearm of claim 17 wherein said frame comprises a main frame member and a plate attached to a side of said main frame member, said plate overlying at least a portion of said trigger bar such that transverse movement of said trigger bar out of the hole in said trigger is prevented as the trigger bar is pushed toward and contacts said plate.

19. The firearm of claim 18 wherein said trigger bar is in the fire position when said trigger bar is proximate to said plate.

20. The firearm of claim 17 wherein said trigger bar comprises a first portion having a first cross-sectional dimension, a second portion having a second cross-sectional dimension smaller than the first cross-sectional dimension and a side wall connecting said first portion and said second portion, and wherein transverse movement of said trigger bar out of the hole in said trigger is prevented as the trigger bar is pushed in a direction from said first portion toward said second portion by contact of said side wall with said frame.

21. The firearm of claim 20 wherein the second portion of said trigger bar overlies and interferes with the upper wall of the trigger guard of said frame upon attempts to pivot said trigger with respect to said frame when said side wall of said trigger bar is proximate to said frame whereby said trigger bar is in the safe position.

22. The firearm of claim 17 wherein said trigger further comprises a spring in contact with and biased toward said trigger bar such that transverse movement of said trigger bar in the hole in said trigger is resisted by frictional engagement of said spring and said trigger bar.

23. The firearm of claim 22 wherein said trigger bar includes a notch therein in a location where said spring contacts said trigger bar when said trigger bar is in the fire position to further resist transverse movement of said trigger bar out of the fire position.

* * * * *